US011460036B2

(12) United States Patent
Tsung-Wei

(10) Patent No.: US 11,460,036 B2
(45) Date of Patent: Oct. 4, 2022

(54) LIGHT EMITTING FAN DEVICE AND NON-LIGHT EMITTING FAN DEVICE

(71) Applicant: COOLER MASTER CO., LTD., New Taipei (TW)

(72) Inventor: Lin Tsung-Wei, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 34 days.

(21) Appl. No.: 17/031,304

(22) Filed: Sep. 24, 2020

(65) Prior Publication Data

US 2021/0102548 A1 Apr. 8, 2021

Related U.S. Application Data

(63) Continuation-in-part of application No. 17/027,329, filed on Sep. 21, 2020.
(Continued)

(51) Int. Cl.
*F04D 29/00* (2006.01)
*F04D 25/08* (2006.01)
(Continued)

(52) U.S. Cl.
CPC ..... *F04D 29/005* (2013.01); *F04D 19/002* (2013.01); *F04D 25/08* (2013.01);
(Continued)

(58) Field of Classification Search
None
See application file for complete search history.

(56) References Cited

U.S. PATENT DOCUMENTS 4,500,821 A 2/1985 Bitting et al.
5,052,472 A 10/1991 Takahashi et al.
(Continued)

FOREIGN PATENT DOCUMENTS

CN 201165989 Y 12/2008
CN 202914337 A 5/2013
(Continued)

OTHER PUBLICATIONS

Non-Final Office Action issued in U.S. Appl. No. 15/433,073, dated Jun. 22, 2018.
(Continued)

*Primary Examiner* — Juan G Flores
(74) *Attorney, Agent, or Firm* — McDermott Will & Emery LLP

(57) ABSTRACT

A cooling device includes a fan frame including a bottom plate and a base part disposed on the bottom plate, a stationary pillar coupled to the fan frame, and a fan assembly that is rotatably disposed about the stationary pillar. The fan assembly is supported on the stationary pillar by at least one bearing positioned between the fan assembly and the stationary pillar. The cooling device also includes a decorative plate coupled to the stationary pillar. The decorative plate has an identifying indicia that permits at least some light to pass therethrough. The cooling device further includes a light emitting assembly disposed on the fan frame and configured to emit light that is directed toward the identifying indicia.

20 Claims, 10 Drawing Sheets

Related U.S. Application Data

(60) Provisional application No. 62/911,920, filed on Oct. 7, 2019.

(51) Int. Cl.

| | |
|---|---|
| ***F04D 29/52*** | (2006.01) |
| ***F04D 29/056*** | (2006.01) |
| ***F04D 29/32*** | (2006.01) |
| ***F04D 19/00*** | (2006.01) |

(52) U.S. Cl.
CPC ..... *F04D 29/056* (2013.01); *F04D 29/329* (2013.01); *F04D 29/522* (2013.01)

(56) References Cited

U.S. PATENT DOCUMENTS

| | | | | |
|---|---|---|---|---|
| 5,738,496 | A | 4/1998 | Mehta | |
| 6,054,676 | A | 4/2000 | Wall et al. | |
| 6,120,262 | A | 9/2000 | McDonough et al. | |
| 6,167,952 | B1 | 1/2001 | Downing | |
| 6,213,617 | B1 | 4/2001 | Barker | |
| 6,966,359 | B1 | 11/2005 | Liu | |
| 7,007,506 | B2 | 3/2006 | Kubo et al. | |
| 7,055,581 | B1 | 6/2006 | Roy | |
| 7,183,939 | B1 | 2/2007 | Lo et al. | |
| 7,240,722 | B2 | 7/2007 | Lai et al. | |
| 7,249,625 | B2 | 7/2007 | Duan | |
| 7,325,591 | B2 | 2/2008 | Duan et al. | |
| 8,051,898 | B2 | 11/2011 | Chiang | |
| 8,240,362 | B2 | 8/2012 | Eriksen | |
| 8,245,764 | B2 | 8/2012 | Eriksen | |
| 8,261,813 | B2 | 9/2012 | Oikawa | |
| 8,746,330 | B2 | 6/2014 | Lyon | |
| 9,345,169 | B1 | 5/2016 | Campbell et al. | |
| 9,441,640 | B2 | 9/2016 | Park et al. | |
| 9,795,058 | B2 | 10/2017 | Tsai | |
| 10,001,127 | B2 * | 6/2018 | Bonham | F04D 25/0606 |
| 10,364,817 | B2 | 7/2019 | Chen et al. | |
| 10,429,059 | B1 * | 10/2019 | Chen | H05K 7/20172 |
| 10,975,876 | B2 * | 4/2021 | Lin | F04D 25/0613 |
| 2003/0049124 | A1 | 3/2003 | Liu | |
| 2004/0130874 | A1 | 7/2004 | Maveety et al. | |
| 2005/0241806 | A1 | 11/2005 | Liu | |
| 2006/0133920 | A1 | 6/2006 | Chen | |
| 2006/0185378 | A1 | 8/2006 | Duan et al. | |
| 2006/0225867 | A1 | 10/2006 | Park et al. | |
| 2007/0248476 | A1 * | 10/2007 | Lewis | F04D 29/005 417/423.1 |
| 2008/0029260 | A1 | 2/2008 | Hu et al. | |
| 2009/0101316 | A1 | 4/2009 | Han et al. | |
| 2009/0122572 | A1 | 5/2009 | Page et al. | |
| 2009/0159244 | A1 | 6/2009 | Mounioloux | |
| 2009/0284921 | A1 | 11/2009 | Colgan et al. | |
| 2012/0152498 | A1 | 6/2012 | Lyon | |
| 2012/0175094 | A1 | 7/2012 | Rice | |
| 2013/0008628 | A1 | 1/2013 | Fiengtum et al. | |
| 2013/0051108 | A1 | 2/2013 | Nagao et al. | |
| 2015/0021756 | A1 | 1/2015 | Adachi | |
| 2016/0309618 | A1 | 10/2016 | Tsai et al. | |
| 2016/0338223 | A1 | 11/2016 | Tsai et al. | |
| 2016/0363967 | A1 | 12/2016 | Tsai | |
| 2017/0045300 | A1 | 2/2017 | Boday et al. | |
| 2017/0045306 | A1 | 2/2017 | Tsai | |
| 2017/0045307 | A1 | 2/2017 | Tsai | |
| 2017/0118870 | A1 | 4/2017 | Yin et al. | |
| 2017/0192471 | A1 | 7/2017 | Tsai et al. | |
| 2017/0235350 | A1 | 8/2017 | Tsai | |
| 2018/0045204 | A1 * | 2/2018 | Van Grootheest | F04D 25/088 |
| 2018/0139865 | A1 | 5/2018 | Draht et al. | |
| 2018/0163960 | A1 | 6/2018 | Lin | |
| 2018/0213677 | A1 | 7/2018 | Wu et al. | |
| 2018/0259267 | A1 | 9/2018 | Tsai et al. | |
| 2018/0332734 | A1 | 11/2018 | Bandorawalla et al. | |
| 2018/0340744 | A1 | 11/2018 | Tsai et al. | |
| 2020/0332804 | A1 * | 10/2020 | Lin | F04D 29/005 |

FOREIGN PATENT DOCUMENTS

| | | | |
|---|---|---|---|
| CN | 202914337 | U | 5/2013 |
| CN | 103133372 | A | 6/2013 |
| DE | 102011121064 | A1 | 6/2013 |
| JP | S61-018159 | A | 1/1986 |
| KR | 10-0529825 | B1 | 11/2005 |
| TW | M278938 | U | 10/2005 |
| TW | M311234 | U | 5/2007 |
| TW | M522274 | U | 5/2016 |

OTHER PUBLICATIONS

Final Office Action issued in U.S. Appl. No. 14/988,753, dated Jan. 11, 2019.
Non-Final Office Action issued in U.S. Appl. No. 14/988,753, dated Aug. 8, 2018.
Final Office Action issued in U.S. Appl. No. 14/988,753, dated Jan. 16, 2018.
Non-Final Office Action issued in U.S. Appl. No. 14/988,753, dated Jul. 31, 2017.
Non-Final Office Action issued in U.S. Appl. No. 15/395,954, dated Feb. 15, 2019.
Final Office Action issued in U.S. Appl. No. 15/433,073, dated Nov. 13, 2018.
Non-Final Office Action issued in U.S. Appl. No. 15/394,410, dated Sep. 21, 2018.
Final Office Action issued in U.S. Appl. No. 15/394,410, dated Jan. 11, 2019.
Notice of Allowance issued in U.S. Appl. No. 15/394,410, dated Apr. 10, 2019.
Notice of Allowance issued in U.S. Appl. No. 15/433,073, dated Apr. 29, 2019.

* cited by examiner

LIGHT EMITTING FAN DEVICE AND NON-LIGHT EMITTING FAN DEVICE

CROSS-REFERENCE TO RELATED APPLICATIONS

This application is a continuation-in-part of U.S. application Ser. No. 17/027,329, filed on Sep. 21, 2020, which claims priority to U.S. Provisional Patent Application 62/911,920, filed Oct. 7, 2019, the entire disclosures of which are incorporated herein by reference.

BACKGROUND

Field

Embodiments of the disclosure are directed a light emitting fan device and a non-light emitting fan device, particularly to a light emitting fan device and a non-light emitting fan device having a decorative plate.

Description of Related Art

With the increase of the processing speed and performance of electronic devices, such as central processing units (CPU), the amount of heat generated during operation of the electronic devices increases. The heat generation increases the temperature of the electronic device and, if the heat cannot be dissipated effectively, the reliability and performance of the electronic device is reduced. To prevent overheating of an electronic device, cooling apparatuses such as fans are used to efficiently dissipate the heat generated by the electronic device and, thereby ensure the standard operation of the electronic device.

In the case of fans or other rotating cooling apparatuses, identifying indicia such as a brand logo, a design, or other markings, are printed on the fan blades for the user to recognize the brand or manufacturer of the fan. However, the identifying indicia rotate when the fan blades rotate, making them unrecognizable to the user.

SUMMARY

Embodiments disclosed are directed to a rotating cooling devices (such as fans) and a non-light emitting rotating cooling devices that allow the user to recognize the identifying indicia (e.g., brand logo, a design, or other markings) during movement of the rotating parts of the cooling devices.

An embodiment of the disclosure includes a cooling device having a fan frame including a bottom plate and a base part disposed on the bottom plate, a stationary pillar coupled to the fan frame, and a fan assembly that is rotatably disposed about the stationary pillar. The fan assembly is supported on the stationary pillar by at least one bearing positioned between the fan assembly and the stationary pillar. The cooling device also includes a decorative plate coupled to the stationary pillar. The decorative plate has an identifying indicia that permits at least some light to pass therethrough. The cooling device further includes a light emitting assembly disposed on the fan frame and configured to emit light that is directed toward the identifying indicia.

Another embodiment of the disclosure includes a cooling device having a fan frame, a stationary pillar coupled to the fan frame, and a fan assembly rotatably disposed about the fixed pillar. The fan assembly is supported on the stationary pillar by at least one bearing positioned between the fan assembly and the stationary pillar. The cooling device also includes a decorative plate coupled to the stationary pillar. The decorative plate has an identifying indicia. The cooling device does not include a light source, and thus, the different components of the cooling device are not illuminated.

According to the embodiments of the disclosure, since the decorative plate of the cooling device is fixed to the stationary pillar instead of the hub of the fan assembly, the decorative plate with identifying indicia does not rotate when the fan assembly rotates relatively to the fan frame. Thus, the user recognizes the identifying indicia on the decorative plate with relative ease.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Embodiments described herein are directed to cooling apparatuses having identifying indicia that is stationary with respect to the moving parts of the cooling apparatus. This permits a user to identify the manufacturer or brand of the cooling apparatus with ease. For instance, in the case of fans or other rotating cooling apparatuses, the identifying indicia is placed on a face plate that is stationary with respect to the rotating fan blades. It should be noted that, although example embodiments are discussed below with reference to fans, example embodiments are not limited in this regard and are equally applicable to other types of rotating cooling devices, without departing from the spirit and scope of the disclosure.

Figure 1:
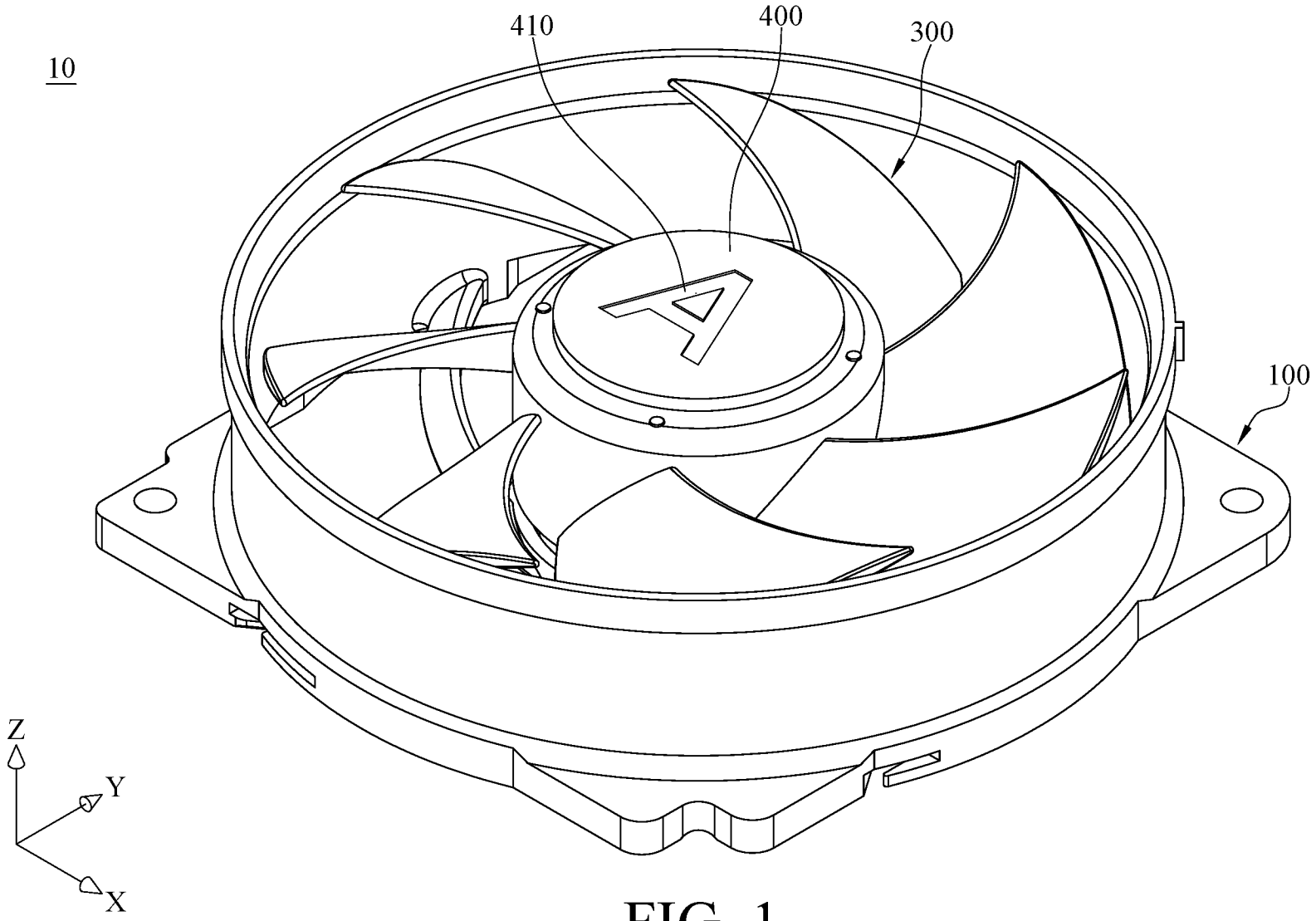
FIG. 1 is a perspective view of a cooling device, according to an embodiment of the disclosure.
Figure 2:
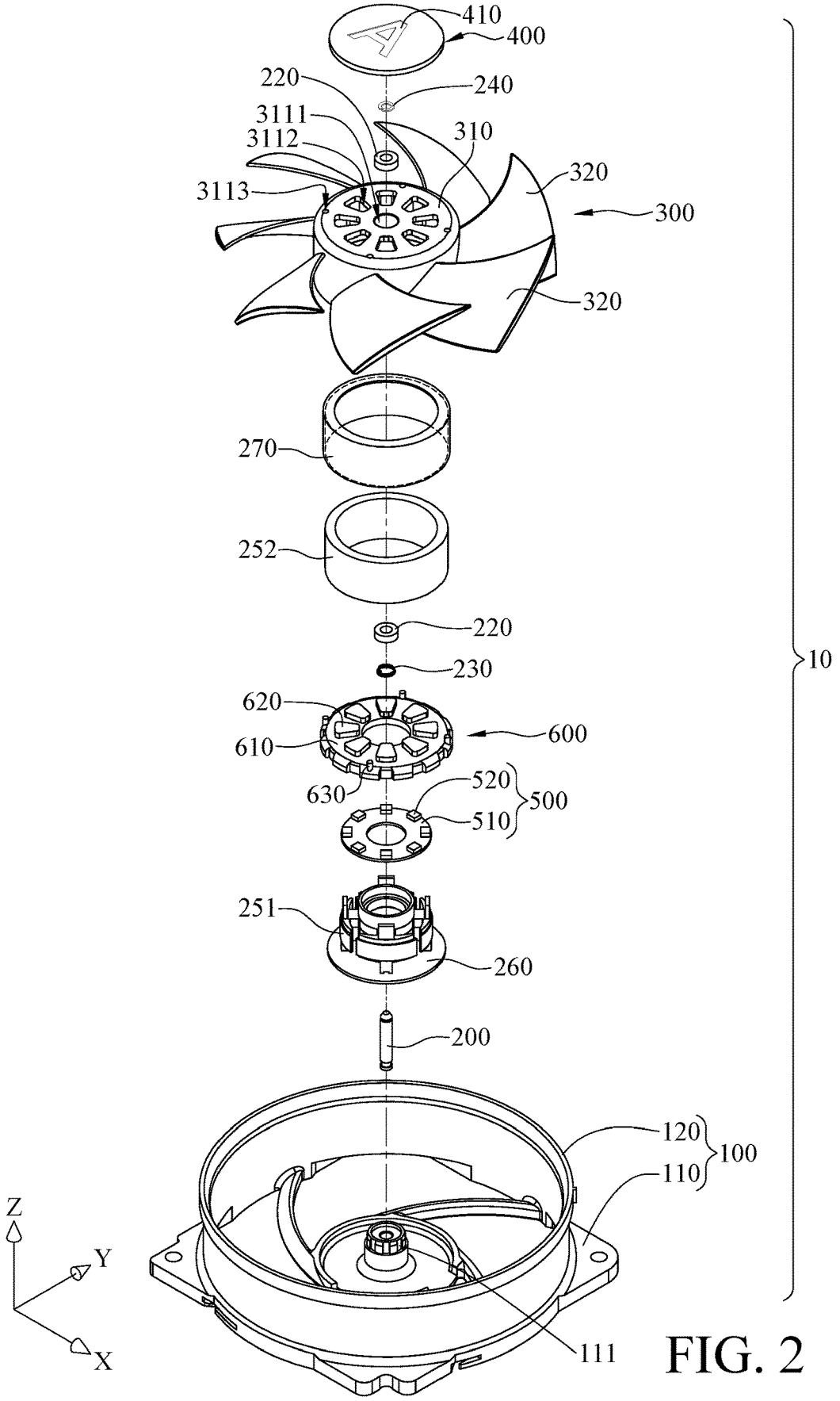
FIG. 2 is an exploded view of the cooling device of FIG. 1.
Figure 3:
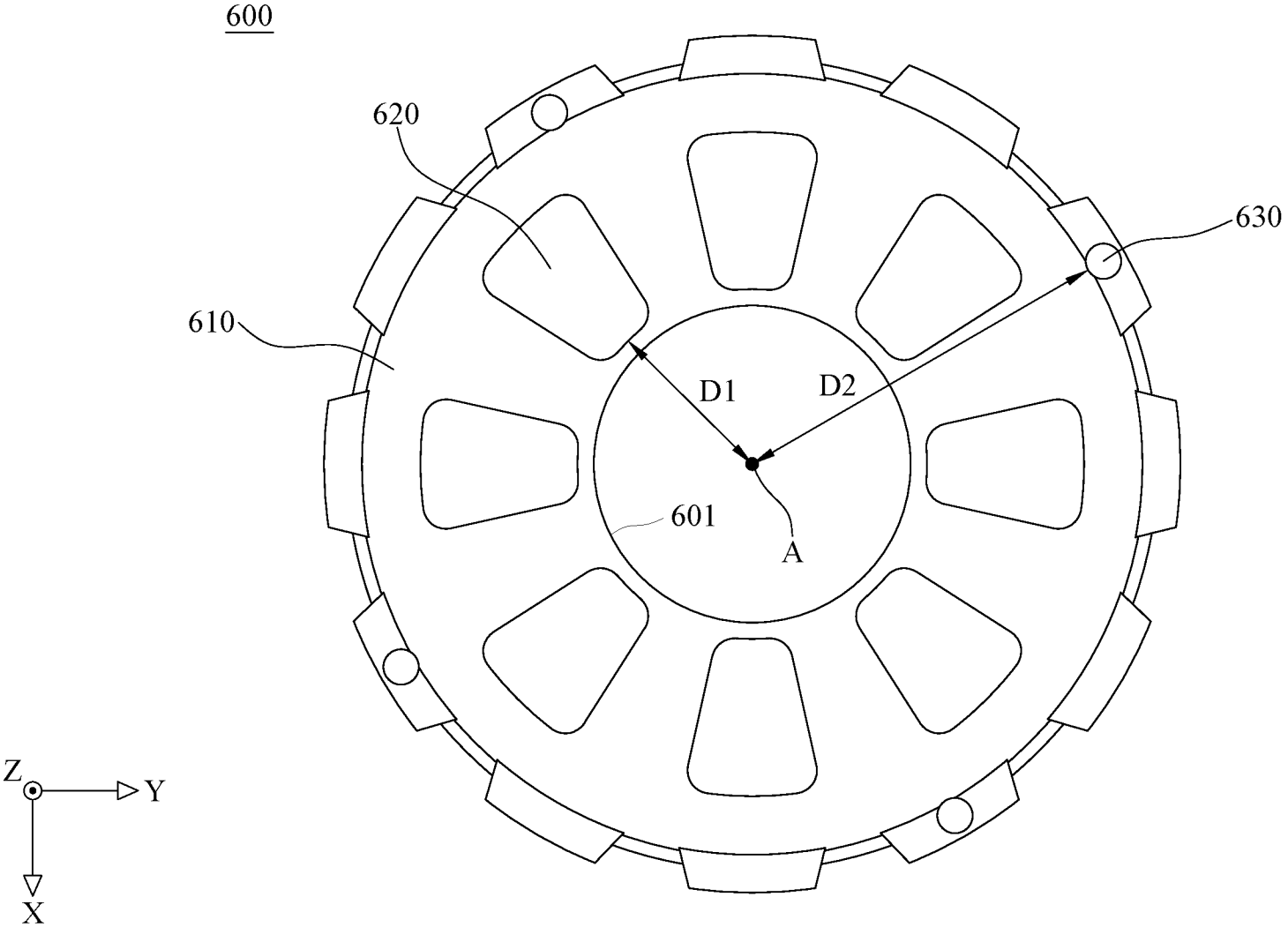
FIG. 3 is a plan view of the light guide plate in FIG. 2.
Figure 4:
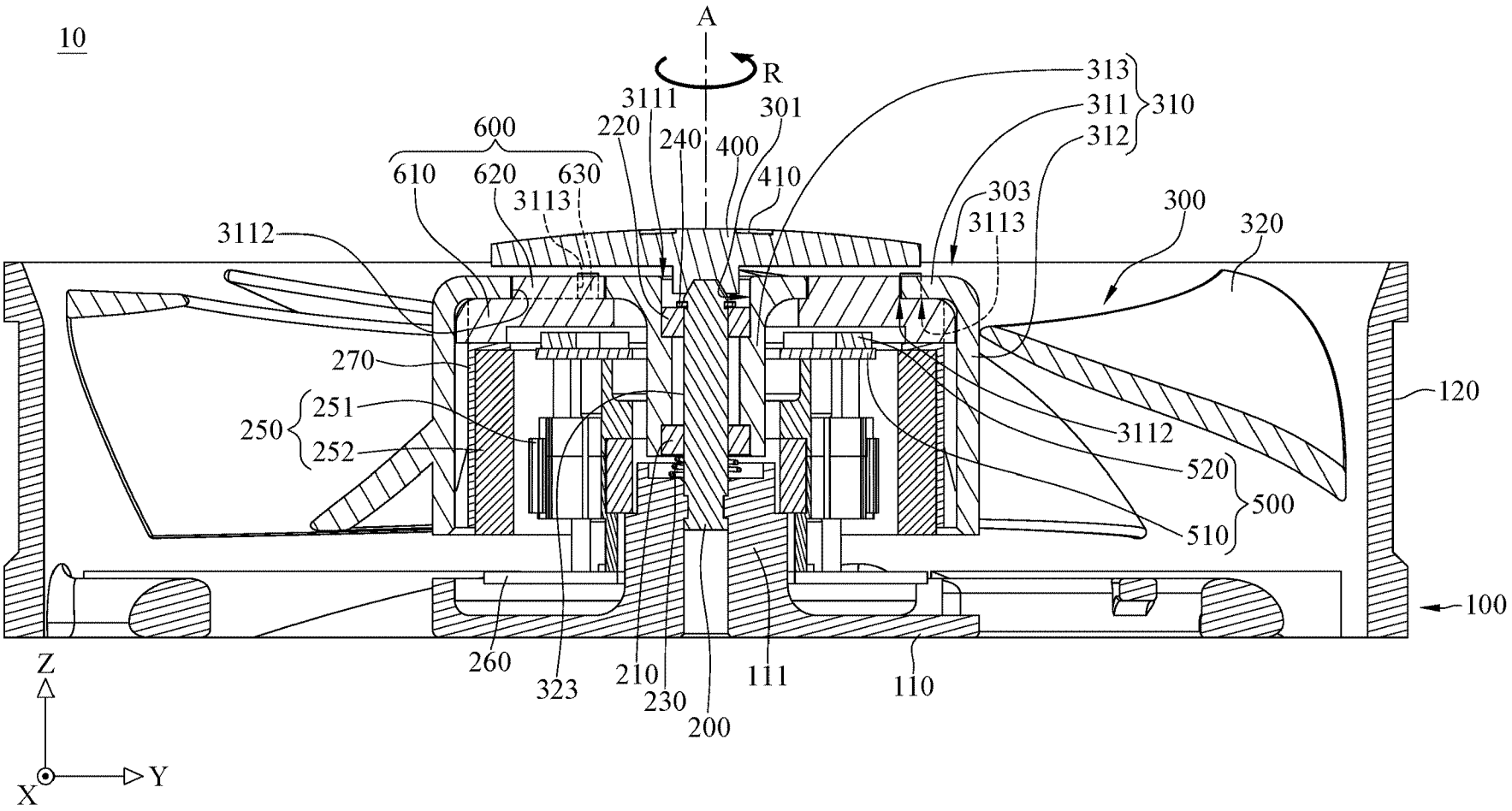
FIG. 4 is a cross-sectional view of the cooling device in FIG. 1, according to embodiment of the disclosure.

FIG. 1 is a perspective view of a cooling device 10, according to an embodiment of the disclosure. FIG. 2 is an exploded view of the cooling device 10 of FIG. 1. FIG. 3 is a plan view of the light guide plate 600 in FIG. 2. FIG. 4 is a cross-sectional view of the cooling device 10 in FIG. 1, according to embodiment of the disclosure. In the embodiment, the cooling device 10 is a fan. However, the principles disclosed herein are also applicable to other types of cooling devices.

Referring to FIGS. 1-4, the cooling device 10 includes a fan frame 100, a pillar (or column) 200, a driving assembly 250, a driving circuit board 260, a fan assembly 300, a decorative plate 400, a light emitting assembly 500, and a light guide plate 600.

The fan frame 100 includes a bottom plate 110 and an annular side plate 120. The bottom plate 110 has a centrally located base part 111. The annular side plate 120 is connected to the bottom plate 110 along a periphery thereof and surrounds the base part 111.

The pillar 200 is fixed vertically to the base part 111, for example, by coupling the pillar 200 to the base part 111, for example, using male-female connectors, snap-fit connectors. In other embodiments, the pillar 200 is fixed to the base part 111 using fasteners (nut, bolts, clips, screws, nails, etc.), adhesives, or other mechanical means. Because the pillar 200 is fixed to the base part 111, the pillar 200 does not rotate when the fan assembly including the fan blades 320 rotates relatively to the fan frame 100 and is stationary.

The fan assembly 300 is rotatably disposed on the pillar 200 (referred to as a stationary pillar 200 hereinafter). The fan assembly 300 includes a hub 310 and a plurality of fan blades 320 extending radially from the hub 310. In an embodiment, the fan blades 320 are arched (or arcuate) structures that are curved or otherwise oriented opposite to the direction of rotation of fan blades 320. The hub 310 includes a cover plate 311 (FIG. 4), an outer annular part 312 (FIG. 4), and an inner annular part 313 (FIG. 4). The hub 310 includes an opening (e.g., a through-hole or lumen) 3111 centrally located therein. The opening 3111 is defined by the inner annular part 313. The cover plate 311 is horizontally (XY plane) disposed over the base part 111 and also defines the opening 3111. The cover plate 311 includes a plurality of openings 3112 and a plurality of openings 3113 arranged about the opening 3111. The cover plate 311 includes a radially inner end 301 defined by the opening 3111 and a radially outer end 303. The outer annular part 312 is connected to and extends vertically downward (Z direction) from the radially outer end 303 and the inner annular part 313 is connected to and extends vertically downward (Z direction) from the radially inner end 301. The outer annular part 312 and the inner annular part 313 are connected to two opposite sides of the cover plate 311 and are radially spaced from each other. The inner annular part 313 at least in part defines the opening 3111. At least a portion of the stationary pillar 200 is located in the opening 3111 and connected to the decorative plate 400. At least a portion of the stationary pillar 200 is received in the decorative plate 400. The plurality of openings 3112 are located radially inward from the plurality of openings 3113 and are located around the opening 3111. Each opening 3112 is sized and shaped or otherwise configured to accommodate a protrusion 620 (discussed below) and each opening 3113 is sized and shaped or otherwise configured to accommodate a column 630 (discussed below).

The fan blades 320 are connected to and extend radially from the outer surface of the outer annular part 312 of the hub 310. In addition, the fan assembly 300 is disposed on the fan frame 100 via the stationary pillar 200 via two bearings 210 and 220, an elastic component 230 and an engagement component 240. In an embodiment, and as illustrated, the elastic component 230 is a spring that is sleeved on the stationary pillar 200, and between bearing 210 and the base part 111. The elastic component 230 presses against the base part 111. The two bearings 210 and 220 are disposed about and in contact with a radially outer surface of stationary pillar 200. The first bearing 210 is disposed at or adjacent an end of the inner annular part 313 proximate the base part 111 while the second bearing 220 is disposed at or adjacent an axially opposite end of the inner annular part 313. The two bearings 210 and 220 surround and press against the stationary pillar 200, and the bearing 210 that is located closer to the base part 111 presses against the elastic component 230. The movement of the bearing 220 that is located away from the base part 111 is limited by the engagement component 240. The inner annular part 313 of the hub 310 of the fan assembly 300 surrounds and presses against the two bearings 210 and 220 and is positioned on the stationary pillar 200 via the two bearings 210 and 220. Therefore, the fan assembly 300 can rotate relatively to the stationary pillar 200 via the two bearings 210 and 220. The engagement component 240 (e.g., a pin, a clip, a retaining ring, etc.) is disposed on the radially outer surface 323 of the stationary pillar 200 and limits the vertical movement of the bearing 220. The elastic component 230 and the engagement component 240 limit vertical movement of the hub 310.

The driving assembly 250 includes a first driving assembly 251 and a second driving assembly 252. In some embodiments, the first driving assembly 251 and the second driving assembly 252 include an electromagnet and a permanent magnet that cooperate with each other. The first driving assembly 251 of the driving assembly 250 is also referred as a stator assembly and is disposed on the driving circuit board 260 which is located on the base part 111. The second driving assembly 252 of the driving assembly 250 is disposed on the hub 310 of the fan assembly 300 via a mount frame 270. The mount frame 270 is constructed of steel. The driving assembly 250 drives the fan assembly 300 to rotate relatively to the stationary pillar 200. For the purposes of the disclosure, any component or assembly that is rotates relative to the fan frame 100 is referred as a rotor or rotor assembly. As such, an assembly including the bearings 210 and 220, the second driving assembly 252, the mount frame 270 and the fan blades 320 that rotates relative to the fan frame 100 is referred as a rotor assembly.

The decorative plate 400 is fixed to the stationary pillar 200 using a variety of techniques. For example, the decorative plate 400 is secured using fasteners (e.g., nuts and bolts, screws, pins, rivets, anchors, seams, crimps, snap-fits, shrink-fits, etc.), magnets, adhesives, male-female engagement features, a combination thereof, and the like. The decorative plate 400 includes an identifying indicia (e.g., brand logo, a design, or other markings) 410. The identifying indicia 410 is transparent or at least translucent and therefore permits light to pass therethrough The decorative plate 400 is made of light-permeable material such as transparent acrylic, and a spray painting process is performed to create the identifying indicia 410. Briefly, in a spray painting process, a mask including a pattern of the identifying indicia 410 is placed on the decorative plate 400. Paint is then applied by spraying and portions of the decorative plate 400 not covered by the pattern are sprayed with the paint and are thus made opaque. As illustrated, the identifying indicia 410 is illustrated as the letter "A", but the disclosure is not limited thereto; in other embodiments, the identifying indicia is a brand name or brand logo, or any desired marking. In an embodiment, the decorative plate 400 and the stationary pillar 200 can be separate, individual components connected to each other. However, embodiments are not limited in this regard and the decorative plate 400' and the stationary pillar 200 are integrally formed with each other as a single unitary (undivided) structure made of light-permeable material.

Referring to FIG. 2, the light emitting assembly 500 includes a circuit board 510 and a plurality of light sources 520. The circuit board 510 is arranged above the driving assembly 250 and is disposed on the fan frame 100 via the driving assembly 250. These light sources 520 are, for example, light emitting diodes and are disposed on a side of the circuit board 510 that is away from the base part 111. The light emitting assembly 500 is positioned within the hub 310 and below the cover plate 311. The number of light sources 520 and the placement of the light sources 520 are not limited in any regard, and any number of light sources 520 can be used and can be placed in any desired arrangement as required by application and design.

FIG. 3 is a plan view of the light guide plate 600 that is disposed on the fan assembly 300 and is at least partially enclosed by the hub 310 and is rotated with the fan assembly 300. Referring to FIG. 3, the light guide plate 600 includes a plate body 610, a plurality of protrusions 620 extending from the plate body 610, and a plurality of columns 630 extending from the plate body 610. The plurality of protrusions 620 are in a circular arrangement about a central opening 601 in the plate body 610. The plurality of columns 630 are arranged at or adjacent the radially outer end of the plate body 610. These protrusions 620 and columns 630 extend from the same side of the plate body 610. The plate body 610 is located inside the hub 310 and each protrusion 620 is received in the corresponding opening 3112 from below the cover plate 311. The arrangement of the protrusions 620 is not limited in any regard, and other configurations of the protrusions 620 and the corresponding openings 3112 are possible, without departing from the scope of the disclosure.

A distance D1 between the protrusion 620 and an axis of rotation A of the stationary pillar 200 is smaller than a distance D2 between the protruding columns 630 and the axis of rotation A. The protrusions 620 and columns 630 are respectively located in the opening 3112 and the opening 3113. It should be noted that the number of protrusions 620 and columns 630 are not limited to those in FIGS. 3 and 4 and can be increased or decreased as per application and design requirements and without departing from the scope of the disclosure. Light emitted from the light sources 520 of the light emitting assembly 500 can travel through the protrusions 620 and the columns 630 of the light guide plate 600. Furthermore, the light from the protrusions 620 illuminates the identifying indicia 410 of the decorative plate 400, and the light coming from the protruding pillars 630 would not be blocked by the decorative plate 400 so it can light up the periphery of the decorative plate 400.

In this way, when the driving assembly 250 drives the fan assembly 300 to rotate relatively to the fan frame 100, the decorative plate 400 does not rotate since it is fixed to the stationary pillar 200, and part of the light emitted from the light sources 520 of the light emitting assembly 500 passes through the protrusions 620 and illuminates the identifying indicia 410 of the decorative plate 400, thus allowing a user to recognize the identifying indicia 410 with relative ease. Some of the light emitted from the light sources 520 of the light emitting assembly 500 passes through the protruding columns 630, and, as a result, the protruding column 630 creates a light ring while rotating with the fan blade 320.

Figure 5:
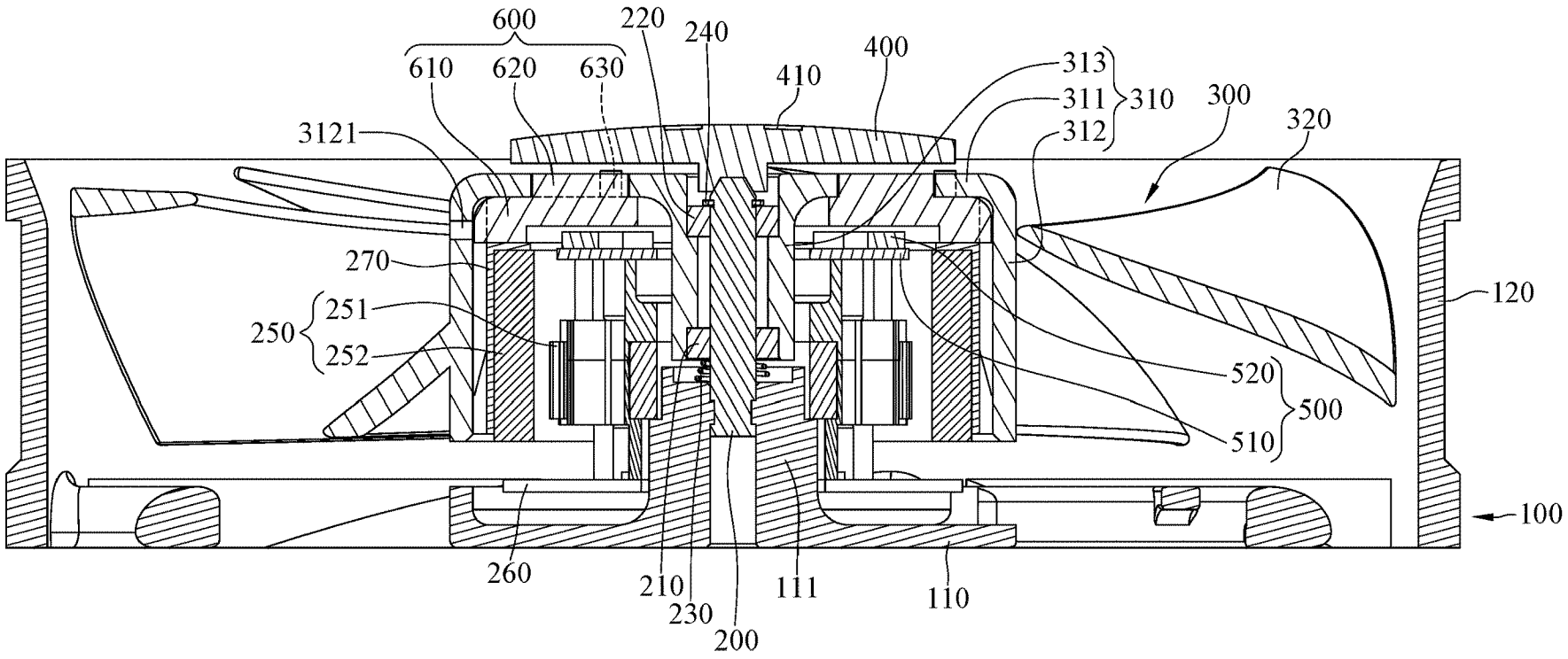
FIG. 5 is a cross-sectional view of the cooling device, according to embodiment of the disclosure.

FIG. 5 is a cross-sectional view of the cooling device 50 according to another embodiment of the disclosure. The cooling device 50 is similar in some respects to the cooling device 10 in FIGS. 1-4, and therefore may be best understood with reference thereto where like numerals designate like components not described again in detail.

In the cooling device 50, the fan assembly 300 is also made of light-permeable material such as transparent or translucent material including acrylic, glass, plastic, etc. The hub 310 is spray painted so that the hub 310 limits passage of light therethrough (e.g., translucent or at least partially opaque). The spray painting process is not performed on the fan blades 320 and thus light can pass through the surfaces of the fan blades 320. As a result, an amount of the light passing through the fan blades 320 is more than the light passing through the hub 310. The outer annular part 312 includes an opening 3121. The light from the light emitting assembly 500 passes through the opening 3121 and illuminates some or all of the fan blades 320.

Figure 6:
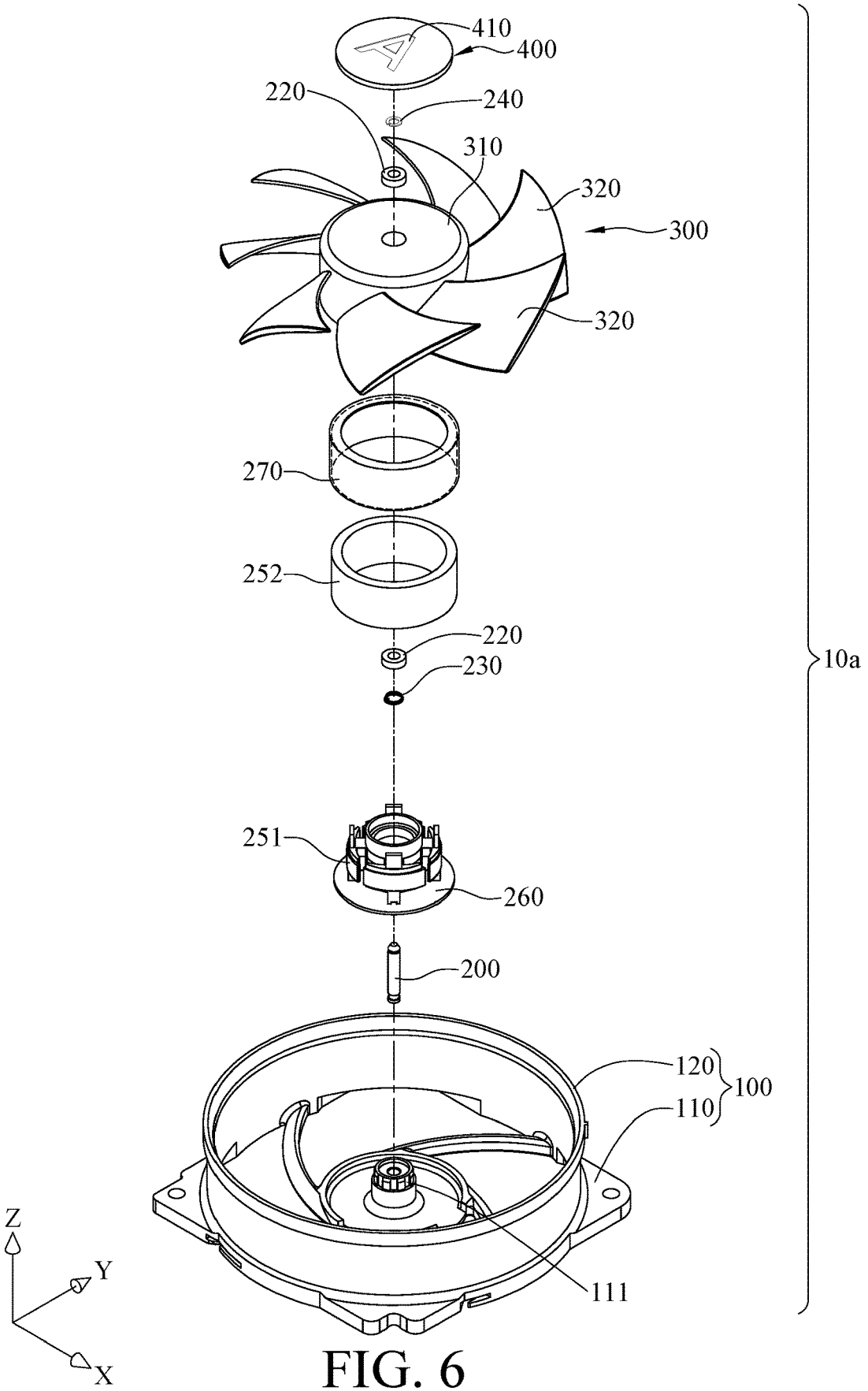
FIG. 6 is an exploded view of a cooling device, according to embodiment of the disclosure.
Figure 7:
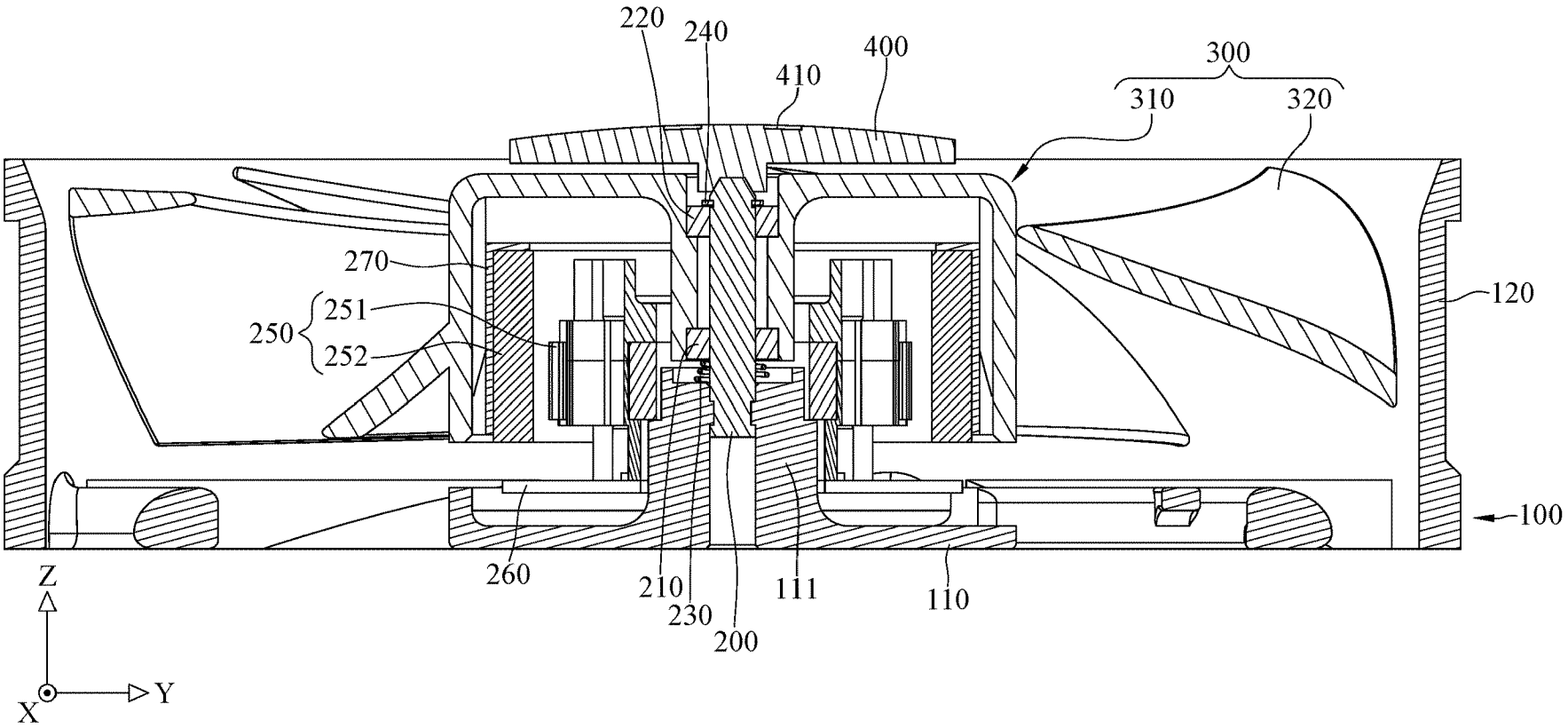
FIG. 7 is a cross-sectional view of the cooling device in FIG. 6, according to embodiment of the disclosure.

FIG. 6 is an exploded view of a cooling device 10*a*. FIG. 7 is a cross-sectional view of the cooling device in FIG. 6. The cooling device 10*a* is similar in some respects to the cooling device 10 in FIGS. 1-4, and therefore may be best understood with reference thereto where like numerals designate like components not described again in detail. As shown in FIGS. 6 and 7, the light emitting assembly 500 and the light guide plate 600 are absent from the cooling device 10*a*. Because the light emitting assembly 500, and thereby the plurality of light sources 520, are absent, the cooling device 10*a* does not emit light. Thus, the hub 310, the fan blades 320, the decorative plate 400, the identifying indicia 410, and other components of the cooling device 10*a* are not illuminated.

Figure 8:
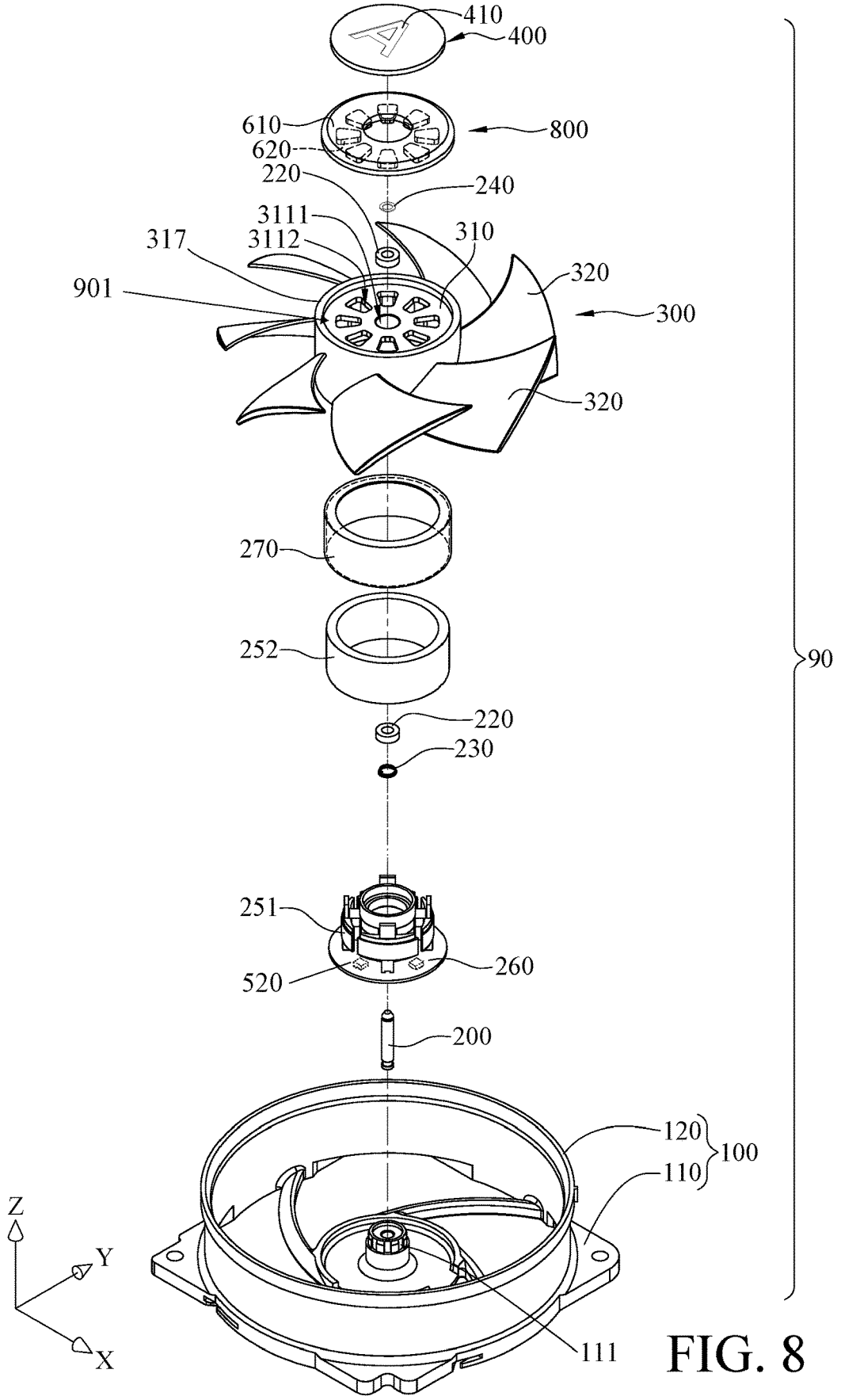
FIG. 8 is an exploded view of a cooling device, according to embodiments of the disclosure.
Figure 9:
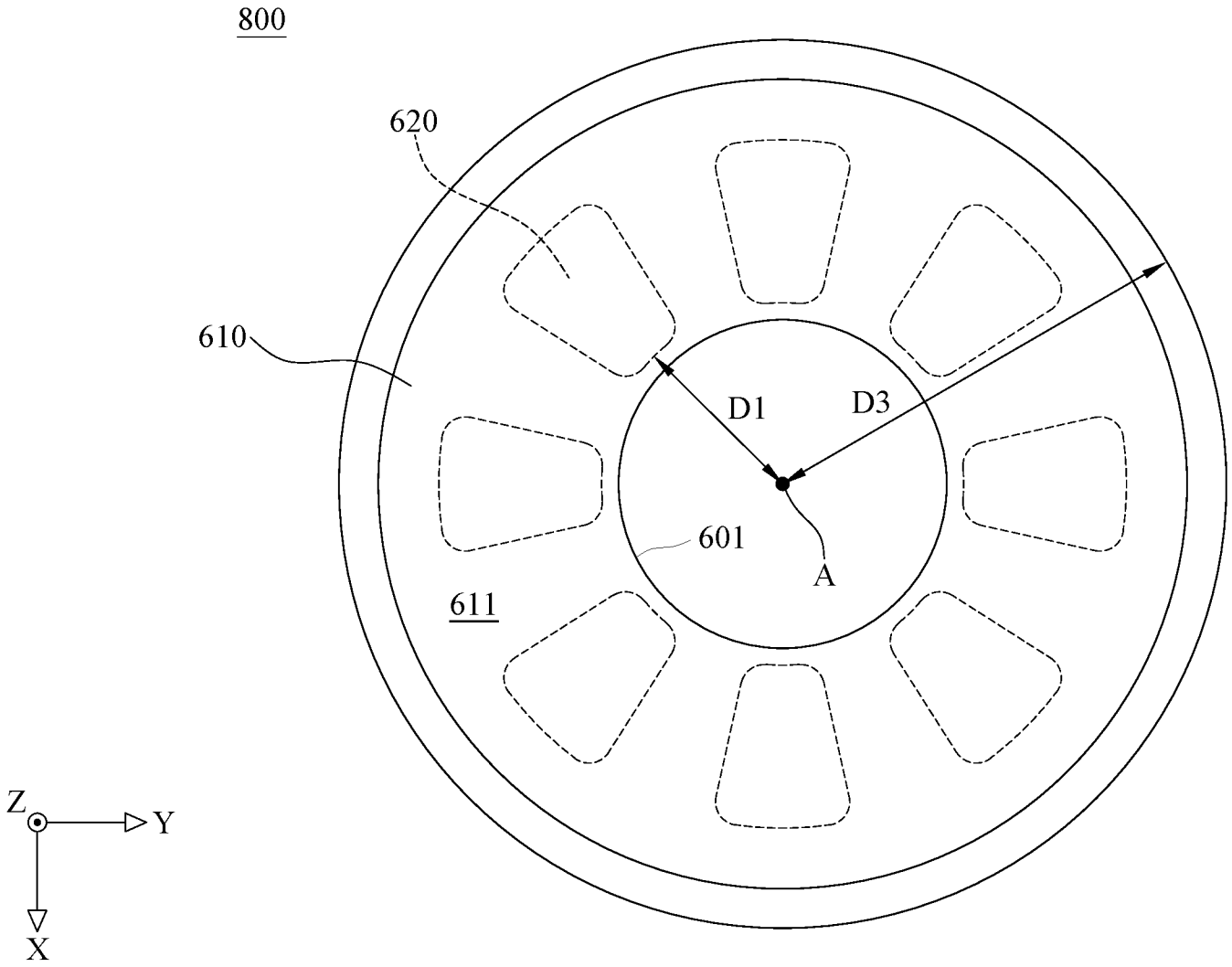
FIG. 9 is a plan view of a light guide plate of the cooling device in FIG. 8, according to embodiments of the disclosure.
Figure 10:
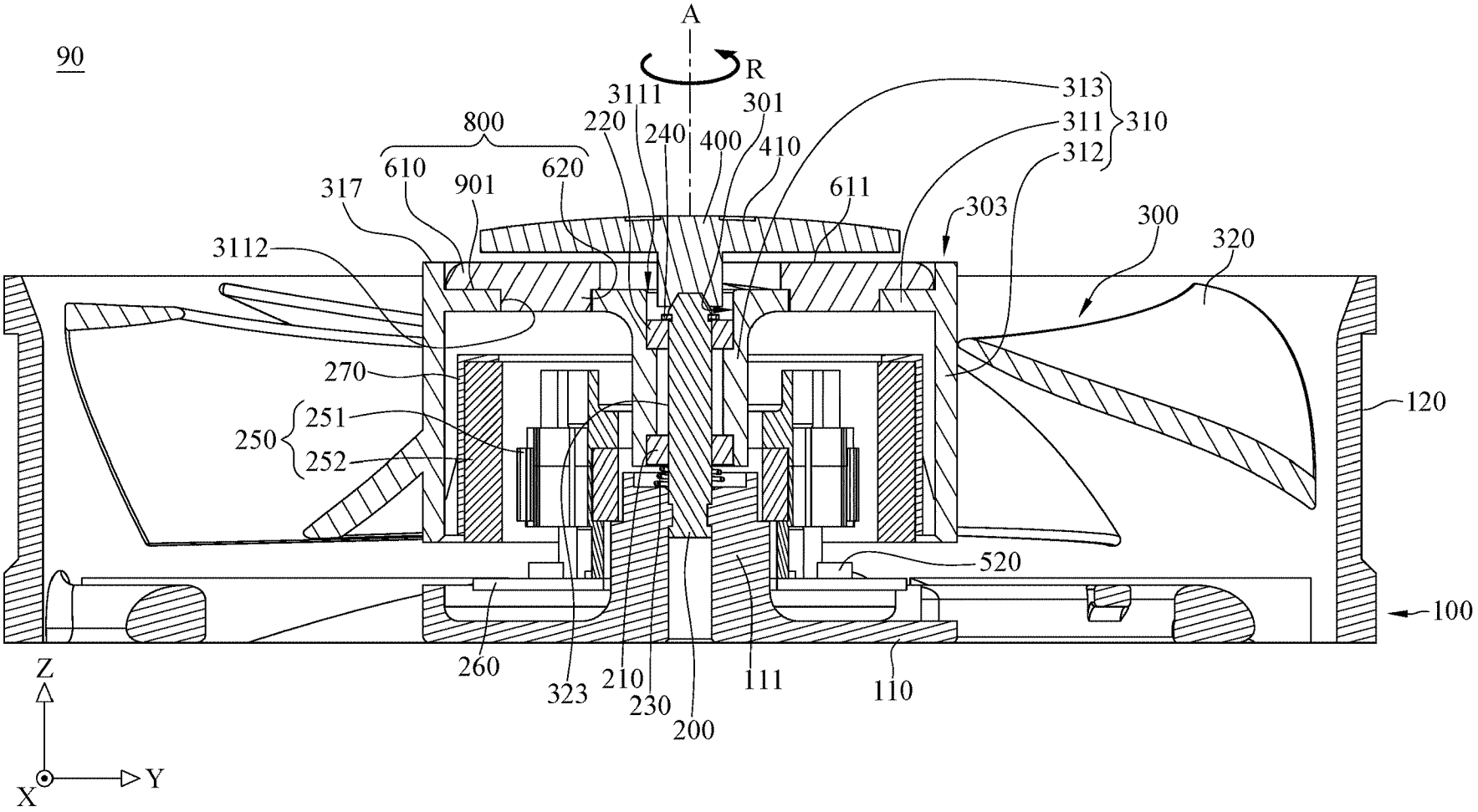
FIG. 10 is a cross-sectional view of the cooling device in FIG. 8.

FIG. 8 is an exploded view of a cooling device 90, according to embodiments of the disclosure. FIG. 9 is a plan view of a light guide plate 800 of the cooling device 90, according to embodiments of the disclosure. FIG. 10 is a cross-sectional view of the cooling device 90 in FIG. 8.

In the cooling device 90, the light guide plate 800 is disposed on the fan assembly 300 and on an upper (top) surface of the hub 310 and is rotated with the fan assembly 300. As illustrated, the hub 310 includes a recess 901 on an upper surface 317 of the cover plate 311 and the light guide plate 800 is received in the recess 901.

The light guide plate 800 is similar in some respects to the light guide plate 600 in FIGS. 1-4, and therefore may be best understood with reference thereto where like numerals designate like components not described again in detail. Referring to FIG. 9, the light guide plate 800 has the plurality of protrusions 620 extending from a lower surface of the plate body 610 in contrast to the light guide plate 600 in which the plurality of protrusions 620 extend from an upper surface of the plate body 610. The plurality of columns 630 are absent in the light guide plate 800. The plurality of protrusions 620 are in a circular arrangement about the central opening 601 in the plate body 610. However, other arrangements are possible. A distance D1 between the protrusion 620 and an axis of rotation A of the stationary pillar 200 is smaller than a distance D3 between the peripheral edge of the light guide plate 800 and the axis of rotation A. As illustrated in FIG. 10, when the light guide plate 800 is located in the recess 901, each protrusion 620 is received in the corresponding opening 3112 from above the cover plate 311 and the top surface 611 of the light guide plate 800 is flush (levelled) with the upper surface 317 of the cover plate 311.

The plurality of light sources 520 are arranged on the driving circuit board 260 (e.g., an upper surface thereof) which is located on the base part 111. In some embodiments, the light sources 520 are light emitting diodes. The light emitting assembly 500 including the circuit board 510 (as in FIGS. 1-5) is absent in the cooling device 90. In some embodiments, the light sources 520 are arranged in concentric circles on the driving circuit board 260. It should be noted, however, that the number of light sources 520 and the placement of the light sources 520 are not limited in any regard, and any number of light sources 520 can be used and can be placed in any desired arrangement as required by application and design.

Light emitted from the light sources 520 travels through the protrusions 620. Furthermore, the light from the protrusions 620 illuminates the identifying indicia 410 of the decorative plate 400. In this way, when the driving assembly 250 drives the fan assembly 300 to rotate relatively to the fan frame 100, the decorative plate 400 does not rotate since it is fixed to the stationary pillar 200, and at least part of the light emitted from the light sources 520 passes through the protrusions 620 and illuminates the identifying indicia 410 of the decorative plate 400, thus allowing a user to recognize the identifying indicia 410 with relative ease.

Although not discussed, it will be understood that one or more of the cooling devices 10, 50, and 10*a* can also be modified to include the light guide plate 800 on an upper surface of the cover plate 311.

According to the cooling device discussed above, since the decorative plate is fixed to the stationary pillar instead of the hub of the fan assembly, the decorative plate with decorative design does not rotate with the fan assembly relatively to the fan frame. This permits a user to more clearly recognize the decorative design on the decorative plate.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A cooling device, comprising:

a fan frame including a bottom plate and a base part disposed on the bottom plate;

a stationary pillar coupled to the fan frame;

a fan assembly, wherein the fan assembly includes a hub and a plurality of fan blades radially extending from the hub, the fan assembly is rotatably disposed about the stationary pillar, and is supported on the stationary pillar by at least one bearing positioned between the fan assembly and the stationary pillar;

a decorative plate coupled to the stationary pillar, the decorative plate having an identifying indicia that permits at least some light to pass therethrough;

a plurality of light sources configured to emit light that is directed toward the identifying indicia; and a light guide plate arranged on an upper surface of the hub.

2. The cooling device according to claim 1, wherein the plurality of fan blades are connected to a sidewall of the hub, the at least one bearing surrounds the stationary pillar, and the hub surrounds the at least one bearing.

3. The cooling device according to claim 2, wherein the hub includes a recess defined in the upper surface thereof and the light guide plate is positioned in the recess.

4. The cooling device according to claim 3, wherein an upper surface of the light guide plate is flushed with the upper surface of the hub.

5. The cooling device according to claim 3, wherein the light guide plate includes a plate body and at least one protrusion extending from a lower surface of the plate body, and wherein the hub includes a cover plate, an inner annular part, and an outer annular part, the inner annular part extends axially from a radially inner end of the cover plate, the outer annular part extends axially from a radially outer end of the cover plate, the cover plate includes the recess on an upper surface thereof, a through hole, and at least one first opening radially outward from the through hole, the stationary pillar is located in the through hole, the at least one protrusion is located in the at least one first opening, and light emitted by the plurality of light sources is directed towards the identifying indicia via the at least one protrusion of the light guide plate.

6. The cooling device according to claim 5, further comprising a driving assembly disposed on a driving circuit board, wherein the driving assembly is configured to drive the fan assembly to rotate relative to the stationary pillar, and wherein the plurality of light sources are arranged on the driving circuit board.

7. The cooling device according to claim 5, wherein the outer annular part includes an opening, and the plurality of light sources is configured to illuminate at least part of the plurality of fan blades via the opening.

8. The cooling device according to claim 5, wherein the hub is translucent or at least partially opaque.

9. The cooling device according to claim 1, wherein a portion of the stationary pillar is received in the decorative plate.

10. The cooling device according to claim 1, wherein the decorative plate is coupled to the stationary pillar using at least one magnet.

11. The cooling device according to claim 1, wherein the plurality of fan blades are connected to a sidewall of the hub, and the cooling device further comprises at least two bearings positioned axially separated from each other and surrounding the stationary pillar, wherein the at least two bearings are disposed between the stationary pillar and the hub.

12. The cooling device according to claim 1, further comprising an elastic component positioned between the base part and the at least one bearing.

13. The cooling device according to claim 12, further comprising an engagement component disposed on a radially outer surface of the stationary pillar and configured to limit vertical movement of the at least one bearing.

14. The cooling device according to claim 13, wherein the elastic component and the engagement component are configured to limit vertical movement of the fan assembly.

15. A cooling device, comprising:

a fan frame;

a stationary pillar coupled to the fan frame;

a fan assembly rotatably disposed about the stationary pillar, wherein the fan assembly is supported on the stationary pillar by at least one bearing positioned between the fan assembly and the stationary pillar;

a driving assembly configured to drive the fan assembly to rotate relative to the stationary pillar; and a decorative plate coupled to the stationary pillar, the decorative plate having an identifying indicia.

16. The cooling device according to claim 15, wherein the fan assembly includes a hub and a plurality of fan blades, the plurality of fan blades are connected to a sidewall of the hub, the at least one bearing surrounds the stationary pillar, and the hub surrounds the at least one bearing.

17. The cooling device according to claim 16, wherein the cooling device further includes at least two bearings positioned axially separated from each other and surrounding the stationary pillar, wherein the at least two bearings are disposed between the stationary pillar and the hub.

18. The cooling device according to claim 15, wherein a portion of the stationary pillar is received in the decorative plate.

19. The cooling device according to claim 15, wherein the decorative plate is coupled to the stationary pillar using at least one magnet.

20. The cooling device according to claim 15, wherein, the cooling device does not include a light source.

* * * * *